US012065853B2

(12) United States Patent
Hayashi et al.

(10) Patent No.: US 12,065,853 B2
(45) Date of Patent: Aug. 20, 2024

(54) LANE ROPE FLOAT

(71) Applicant: GIFU PLASTIC INDUSTRY CO., LTD., Gifu (JP)

(72) Inventors: Hidetoshi Hayashi, Gifu (JP); Hidero Ozawa, Gifu (JP)

(73) Assignee: Gifu Plastic Industry Co. Ltd., Gifu (JP)

( * ) Notice: Subject to any disclaimer, the term of this patent is extended or adjusted under 35 U.S.C. 154(b) by 22 days.

(21) Appl. No.: 18/079,253

(22) Filed: Dec. 12, 2022

(65) Prior Publication Data

US 2023/0112683 A1 Apr. 13, 2023

Related U.S. Application Data

(63) Continuation of application No. 16/615,368, filed as application No. PCT/JP2018/021102 on Jun. 1, 2018, now Pat. No. 11,560,729.

(30) Foreign Application Priority Data

Jun. 2, 2017 (JP) ..... 2017-110023

(51) Int. Cl.
*E04H 4/14* (2006.01)

(52) U.S. Cl.
CPC ..... *E04H 4/143* (2013.01)

(58) Field of Classification Search
CPC ..... E04H 4/143
See application file for complete search history.

(56) References Cited

U.S. PATENT DOCUMENTS 3,786,521 A * 1/1974 Walket ..... E04H 4/143 4/497
4,048,677 A 9/1977 Kajlich
4,052,755 A 10/1977 Baker
(Continued)

FOREIGN PATENT DOCUMENTS

CN 2784506 Y * 5/2006 ..... E04H 4/143
JP S55139000 U 10/1980
(Continued)

OTHER PUBLICATIONS

Machine Translation of CN 2784506 Y retrieved on Apr. 7, 2023 (Year: 2023).*

(Continued)

*Primary Examiner* — Janie M Loeppke
(74) *Attorney, Agent, or Firm* — Blueshift IP; Robert Plotkin

(57) ABSTRACT

A lane rope float having higher wave absorbing performance than before is provided. A lane rope float is one that is attached to a rope R via a tubular portion and divides lanes of a pool, and the lane rope float is characterized by: including a plurality of blades that protrude from a side surface of the tubular portion in parallel with the rope R, and a wall surface portion that is coupled to side end portions of the blades to cover the blades, in which in an outer end portion of the lane rope float from the center of the tubular portion to the wall surface portion, at least ½ of the range from the center of the tubular portion to the wall surface portion is formed along a vertical plane V2 perpendicular to the tubular portion.

2 Claims, 9 Drawing Sheets

(56) References Cited

U.S. PATENT DOCUMENTS

| | | | |
|---|---|---|---|
| 4,616,369 | A | 10/1986 | Rademacher |
| 5,520,562 | A | 5/1996 | Eddy |
| 11,560,729 | B2 | 1/2023 | Hayashi et al. |
| 2020/0199900 | A1 | 6/2020 | Hayashi et al. |

FOREIGN PATENT DOCUMENTS

| | | | |
|---|---|---|---|
| JP | S6115920 | Y2 | 5/1986 |
| JP | H03058500 | U | 6/1991 |
| JP | 08071260 | A | 3/1996 |
| JP | H0871260 | A | 3/1996 |
| JP | 3029377 | U | 9/1996 |
| WO | 9721889 | A1 | 6/1997 |

OTHER PUBLICATIONS

International Search Report dated Aug. 14, 2018, in International patent application No. PCT/JP2018/021102, 2 pages.
Non-Final Office Action dated May 25, 2022, in U.S. Appl. No. 16/615,368 of Hidetoshi Hayashi, filed Nov. 20, 2019, 17 pages.
Notice of Allowance dated Sep. 16, 2022, in U.S. Appl. No. 16/615,368 of Hidetoshi Hayashi, filed Nov. 20, 2019, 8 pages.

* cited by examiner

Fig. 8a
PRIOR ART
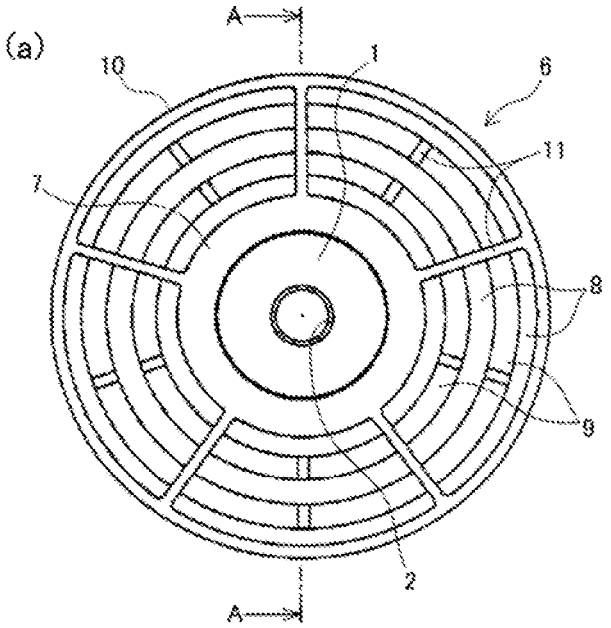
Fig. 8b
PRIOR ART
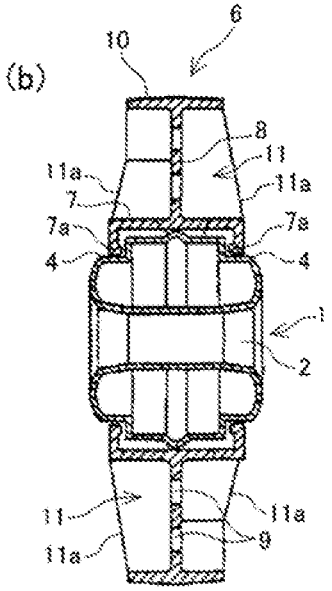
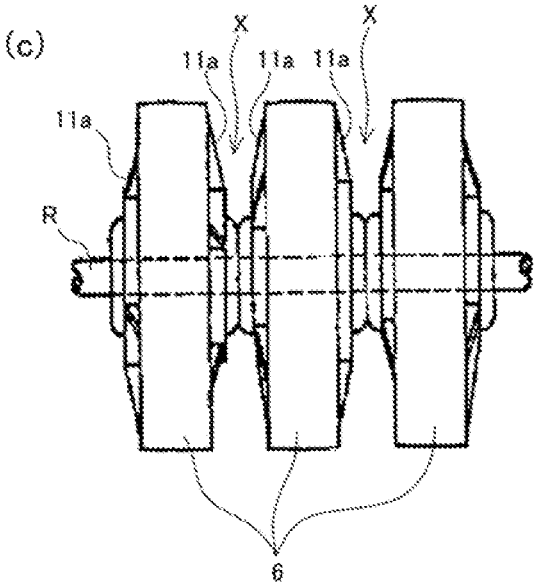
Fig. 8c
PRIOR ART

LANE ROPE FLOAT

TECHNICAL FIELD

The invention of the present application relates to a lane rope float to be installed in a swimming pool or the like.

BACKGROUND ART

Various types of lane rope floats have been known, and, for example, the lane rope float disclosed in Patent Literature 1 includes, as illustrated in FIGS. 8(*a*) and 8(*b*): a hollow inner float 1 having a rope insertion hole 2 for inserting a rope R formed at the center of the inner float 1 and having small-diameter step portions 4 on the left and right outsides; and an outer float 6 having a boss 7 with a smaller width than the inner float 1, having a water insertion hole 9 in a central arm 8, and having a blade 11 formed between the boss 7 and a rim 10, in which both the floats are combined in a freely rotating manner by engaging small-diameter inner surfaces 7*a* on both sides of the boss of the outer float 6 with the small-diameter step portions 4 of the inner float 1.

A plurality of the lane rope floats are installed along the rope R in a pool, as illustrated in FIG. 8(*c*), whereby lanes are divided. The lane rope float swings in response to the waves created by a swimmer in each lane in the state of floating on the water surface, whereby it attenuates and absorbs the waves, that is, it performs "wave absorption".

However, outer ends 11*a* of the left and right blades 11 of the lane rope float are gradually inclined toward the outer circumferential surface of the outer float 6, as illustrated in FIG. 8(*c*), and hence a big gap X exists between the lane rope floats. Therefore, part of the waves created by a swimmer in each lane pass to the adjacent lane via the gap X, and hence with the lane rope float disclosed in this Patent Literature 1, there is a problem that the wave absorbing performance is low.

CITATION LIST

Patent Literature

Patent Literature 1: Japanese examined utility model application publication No. Sho61-15920

SUMMARY OF INVENTION

Technical Problem

So, in view of the above problem, the invention of the present application provides a lane rope float having higher wave absorbing performance than before.

Solutions to Problem

In order to solve the above problem, a lane rope float according to claim 1 of the invention of the present application is one that is attached to a rope via a tubular portion and divides lanes of a pool, and the lane rope float is characterized by: including a plurality of blades that protrude from a side surface of the tubular portion in parallel with the rope, and a wall surface portion that is coupled to side end portions of the blades to cover the blades, in which in an outer end portion of the lane rope float from the center of the tubular portion to the wall surface portion, at least ½ of the range from the center of the tubular portion to the wall surface portion is formed along a vertical plane perpendicular to the tubular portion.

According to the above characteristic, when a plurality of the lane rope floats are attached to a rope, the outer end portions, facing each other, of the adjacent lane rope floats are extremely close to each other in a state of being parallel with each other within at least ½ of the range from the center of the tubular portion to the wall surface portion. As a result, the gap between the adjacent lane rope floats becomes remarkably smaller as compared with the big gap between the lane rope floats of conventional technologies. According to the lane rope float of the invention of the present application, the gap is remarkably small, and hence the waves created by a swimmer in each lane are hardly allowed to pass to the adjacent lane, whereby wave absorbing performance is more improved than before.

Further, a lane rope float according to claim 2 of the invention of the present application is one that is attached to a rope via a tubular portion and divides lanes of a pool, and the lane rope float is characterized by: including a plurality of blades that protrude from a side surface of the tubular portion in parallel with the rope, and a wall surface portion that is coupled to side end portions of the blades to cover the blades, in which in an outer end portion of the lane rope float from the side surface of the tubular portion to the wall surface portion, at least ½ of the range from the side surface of the tubular portion to the wall surface portion is formed along a vertical plane perpendicular to the tubular portion.

According to the above characteristic, when a plurality of the lane rope floats are attached to a rope, the outer end portions, facing each other, of the adjacent lane rope floats are extremely close to each other in a state of being parallel with each other within at least ½ of the range from the side surface of the tubular portion to the wall surface portion. As a result, the gap between the adjacent lane rope floats becomes remarkably smaller as compared with the big gap between the lane rope floats of conventional technologies. According to the lane rope float of the invention of the present application, the gap is remarkably small, and hence the waves created by a swimmer in each lane are hardly allowed to pass to the adjacent lane, whereby wave absorbing performance is more improved than before.

Furthermore, a lane rope float according to claim 3 of the invention of the present application is one that is attached to a rope via a tubular portion and divides lanes of a pool, and the lane rope float is characterized by: including a plurality of blades that protrude from a side surface of the tubular portion in parallel with the rope, and a wall surface portion that is coupled to side end portions of the blades to cover the blades, in which in one outer end portion of the lane rope float from the side surface of the tubular portion to the wall surface portion, at least ½ of the range from the side surface of the tubular portion to the wall surface portion is formed into a convex shape or a concave shape, and the other outer end portion of the lane rope float is formed into a concave shape or a convex shape so as to correspond to the convex shape or the concave shape of the one outer end portion.

According to the above characteristic, when a plurality of the lane rope floats are attached to a rope, an outer end portion of one of the adjacent lane rope floats and an outer end portion of the other lane rope float are extremely close to each other in a state of being parallel with each other while keeping a predetermined distance between them, within at least ½ of the range from the side surface of the tubular portion to the wall surface portion. As a result, the gap between the adjacent lane rope floats becomes remarkably smaller as compared with the big gap between the lane rope floats of conventional technologies. According to the lane rope float of the invention of the present application, the gap is remarkably small, and hence the waves created by a swimmer in each lane are hardly allowed to pass to the adjacent lane, whereby wave absorbing performance is more improved than before.

Still furthermore, a lane rope float according to claim 4 of the invention of the present application is characterized with a protrusion protruding outward formed in the outer end portion.

According to the above characterization, when a plurality of the lane rope floats are attached to a rope, the protrusion first comes into contact with the outer end portion of the adjacent lane rope float even if the adjacent lane rope floats collide with each other by being shaken with waves, and hence the adjacent outer end portions can be prevented from being caught with each other.

Still furthermore, a lane rope float according to claim 5 of the invention of the present application is characterized by being configured to have a specific gravity of 0.4 to 0.6 such that when the lane rope float is attached to a rope installed in a pool, two blades, lined up in a straight line around the tubular portion, can be located at a height substantially the same as a water surface of the pool.

According to the above characteristic, when the lane rope float is installed such that two blades, lined up in a straight line around the tubular portion, are located at a height substantially the same as the water surface, a lower half of the lane rope float just sinks in water, and hence wave absorbing performance is improved.

Still furthermore, a lane rope float according to claim 6 of the invention of the present application is characterized by being configured to have a specific gravity of 0.4 to 0.6 such that when the lane rope float is attached to a rope installed in a pool, a portion of the lane rope float, above the tubular portion, can be located above the water surface of the pool.

According to the above characteristic, when a portion of the lane rope float, above the tubular portion, is located above the water surface, an approximately lower half of the lane rope float sinks in water, and hence wave absorbing performance is improved.

Still furthermore, a lane rope float according to claim 7 of the invention of the present application is characterized with the blade formed to be gradually thicker from the tubular portion to the wall surface portion.

According to the above characteristic, a moment of inertia of an outermost portion of the lane rope float becomes large, and hence when the lane rope float swings around a rope by wave power, the lane rope float has to use a lot of wave energy, whereby wave absorbing performance is improved that much.

Still furthermore, a lane rope float according to claim 8 of the invention of the present application is characterized with the wall surface portion formed to be thicker than the blade.

According to the above characteristic, a moment of inertia of an outermost portion of the lane rope float becomes large, and hence when the lane rope float swings around a rope by wave power, the lane rope float has to use a lot of wave energy, whereby wave absorbing performance is improved that much.

Still furthermore, a lane rope float according to claim 9 of the invention of the present application is characterized by being configured such that when a plurality of the lane rope floats are continuously attached to a rope, a void ratio among the lane rope floats within the range of 1 m inside view is 5% or less.

According to the above characteristic, the waves created by a swimmer in each lane are hardly allowed to pass to the adjacent lane by making the void ratio 5% or less, and hence wave absorbing performance is more improved than before.

Advantageous Effects of Invention

According to the lane rope float of the invention of the present application, wave absorbing performance is higher than before.

BRIEF DESCRIPTION OF DRAWINGS

FIG. 8(*a*) is a front view of a lane rope float according to conventional technologies in the invention of the present application, FIG. 8(*b*) is a sectional view taken along the A-A line in FIG. 8(*a*), and FIG. 8(*c*) is a side view of a state in which a plurality of the lane rope floats are attached to a rope.

REFERENCE SIGNS LIST

Figure 1:
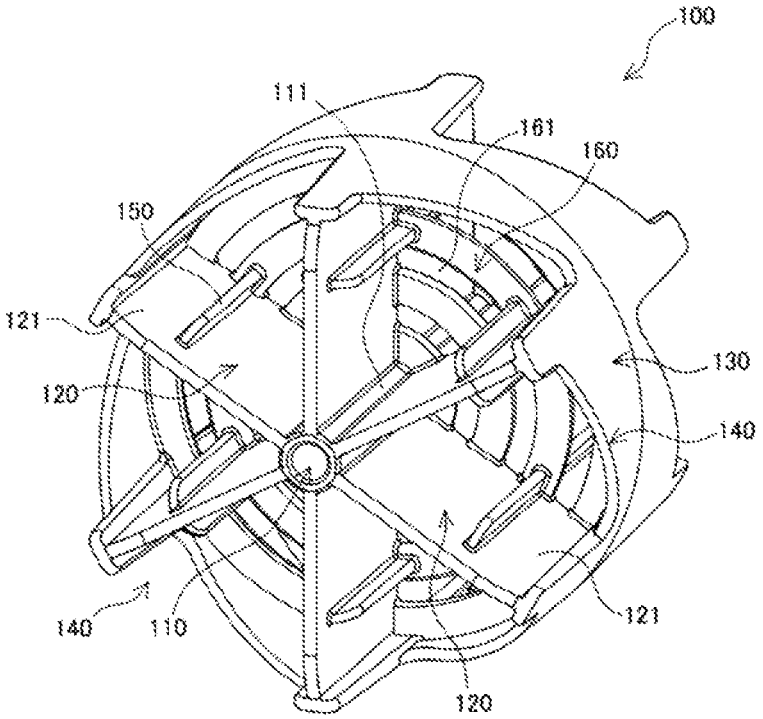
FIG. 1 is an overall perspective view of a lane rope float according to a first embodiment of the invention of the present application.

100 lane rope float
110 tubular portion
111 side surface
120 blade
121 side end portion
130 wall surface portion
170 outer end portion
V2 vertical plane
R rope

DESCRIPTION OF EMBODIMENTS

Hereinafter, embodiments of the invention of the present application will be described with reference to drawings.

First Embodiment

Figures 2A, 2B:
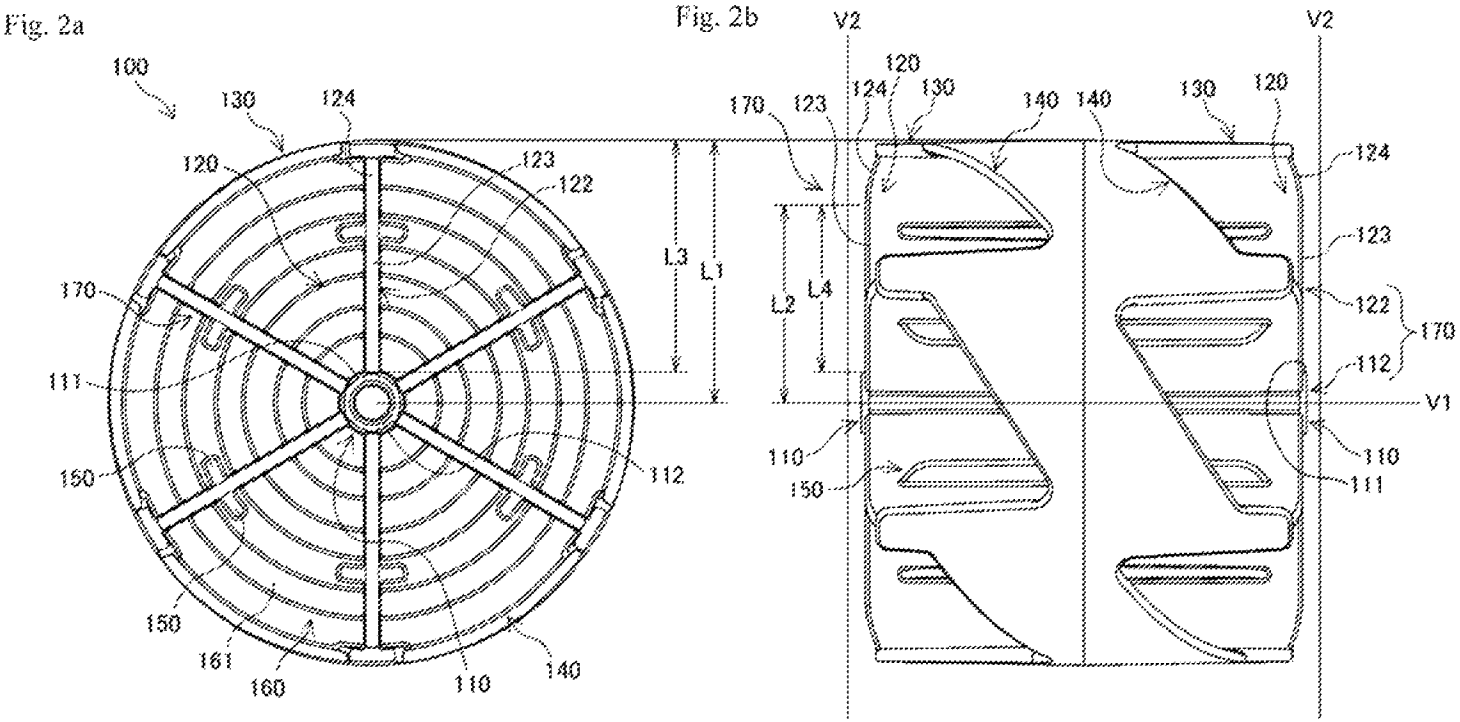
FIG. 2(*a*) is a front view of a lane rope float, and FIG. 2(*b*) is a side view of the lane rope float.

First, a lane rope float 100 according to a first embodiment of the invention of the present application is illustrated in FIGS. 1 and 2. FIG. 1 is an overall perspective view of the lane rope float 100, FIG. 2(*a*) is a front view of the lane rope float 100, and FIG. 2(*b*) is a side view of the lane rope float 100.

This lane rope float 100 includes: a tubular portion 110 having a long cylindrical shape that is located at the center of the lane rope float 100 and through which a rope R can be inserted; a plurality of blades 120 that protrude from a side surface 111 of the tubular portion 110 in parallel with the rope R; and a wall surface portion 130 that is coupled to side end portions 121 of the blades 120 to cover the blades 120.

The wall surface portion 130 between the adjacent blades 120 is formed obliquely. Openings 140 are formed on both sides of the portion formed obliquely, and waves traveling from the side enter the inside of the lane rope float 100 from the opening 140. Further, a protruding plate 150 parallel with the rope R is formed on an inner surface of the blade 120 so as to protrude from the surface. Since the waves that have entered from the opening 140 collide with the protruding plates 150, turbulent flows are more likely to occur in the lane rope float 100.

As illustrated in FIG. 2, each of outer end portions 170 on both sides of the lane rope float 100 includes an outer end 112 of the tubular portion 110 and an outer end 122 of the blade 120. The outer end 112 of the tubular portion 110 protrudes slightly more than the outer end 122 of the blade 120. This is because when a plurality of the lane rope floats 100 are attached to the rope R to be used, as described later, the outer end portions 170 of the adjacent lane rope floats 100 are prevented from being caught with each other.

Furthermore, the outer end 122 of the blade 120 includes: a linear along-end portion 123 that extends along a vertical plane V2 perpendicular to a central axis V1 of the tubular portion 110 and extends in parallel with the vertical plane V2; and an inclined portion 124 that is inclined from the along-end portion 123 toward the position of the inner circumferential surface of the wall surface portion 130. The inclined portion 124 functions such that when a plurality of the lane rope floats 100 are attached to the rope R to be used, as described later, the wall surface portions 130 of the adjacent lane rope floats 100 or side ends of the outer end portions 170 are prevented from being caught with each other.

When it is assumed that the length of the outer end portion 170 between the center of the tubular portion 110 and the wall surface portion 130 is L1, a length L2 between the center of the tubular portion 110 and the end portion of the along-end portion 123 is at least ½ of the length L1 or more. That is, in the outer end portion 170 of the lane rope float 100, at least ½ of the range from the center of the tubular portion 110 to the wall surface portion 130 is formed along the vertical plane V2 perpendicular to the tubular portion 110.

Figure 6C:
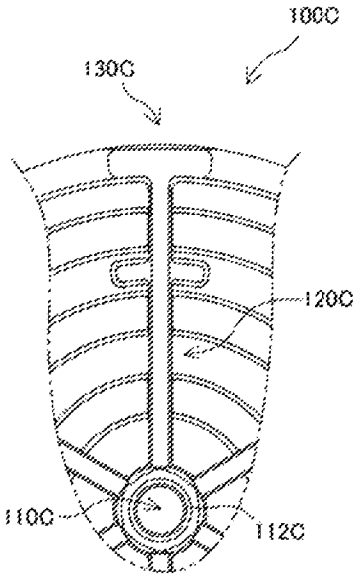
FIG. 6(*a*) is a side view of a lane rope float according to a first variation of the invention of the present application, in which a portion near an outer end portion is enlarged, FIG. 6(*b*) is a front view of a lane rope float according to a second variation of the invention of the present application, in which a portion near a blade is enlarged, and FIG. 6(*c*) is a front view of a lane rope float according to a third variation of the invention of the present application, in which a portion near a blade is enlarged.
Figure 6B:
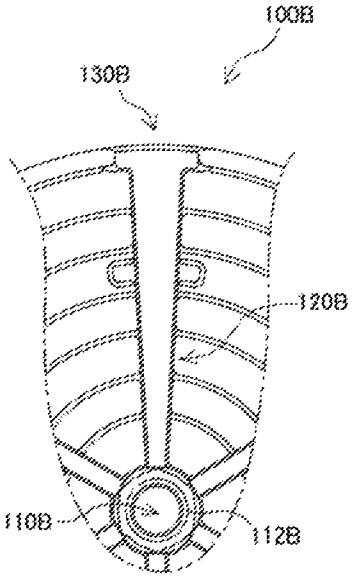
Figure 6A:
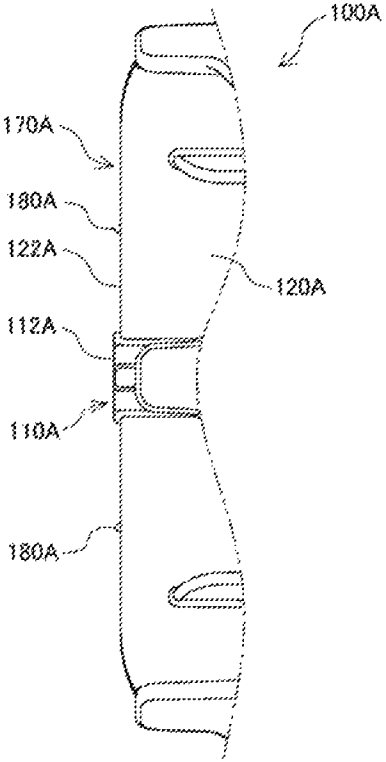

The fact that in the outer end portion 170 of the lane rope float 100, at least ½ of the range from the center of the tubular portion 110 to the wall surface portion 130 is formed along the vertical plane V2 includes not only the case where even if the outer end 112 of the tubular portion 110 slightly protrudes, the entirety of at least ½ of the range from the center of the tubular portion 110 to the wall surface portion 130 extends linearly along the vertical plane V2, as illustrated in FIGS. 1 and 2, but also the case where a protrusion 180A is formed on the surface of the outer end portion 170, as described later with reference to FIG. 6(*a*).

In the outer end portion 170 of the lane rope float 100, the range formed along the vertical plane V2 can be appropriately changed within the range from ½ of the length L1 between the center of the tubular portion 110 and the wall surface portion 130 to a length equal to the length L1. For example, ⅔ of the range from the center of the tubular portion 110 to the wall surface portion 130 may be formed along the vertical plane V2. When the range formed along the vertical plane V2 is set to ½ of the length L1, the along-end portion 123 should be shortened such that the length L2 between the center of the tubular portion 110 and the end portion of the along-end portion 123 is equal to ½ of the length L1. When the range formed along the vertical plane V2 is set to a length equal to the length L1, the along-end portion 123 should be extended to the position of the outer circumferential surface of the wall surface portion 130 by eliminating the inclined portion 124.

In the outer end portion 170 of the lane rope float 100 of the invention of the present application, the range from the center of the tubular portion 110 to the wall surface portion 130 has been described so far; however, in addition to that, the lane rope float 100 of the invention of the present application also has a characteristic about the range from the side surface 111 of the tubular portion 110 to the wall surface portion 130, which will be described below.

First, when it is assumed that the length of the outer end portion 170 between the side surface 111 of the tubular portion 110 and the wall surface portion 130 is L3, a length L4 of the along-end portion 123 is at least ½ of the length L3 or more. That is, in the outer end portion 170 of the lane rope float 100, at least ½ of the range from the side surface 111 of the tubular portion 110 to the wall surface portion 130 is formed along the vertical plane V2 perpendicular to the tubular portion 110.

The fact that in the outer end portion 170 of the lane rope float 100, at least ½ of the range from the side surface 111 of the tubular portion 110 to the wall surface portion 130 is formed along the vertical plane V2 includes not only the case where the entirety of at least ½ of the range from the side surface 111 of the tubular portion 110 to the wall surface portion 130 extends linearly along the vertical plane V2, as illustrated in FIGS. 1 and 2, but also the case where the protrusion 180A is formed on the surface of the outer end portion 170, as described later with reference to FIG. 6(*a*).

In the outer end portion 170 of the lane rope float 100, the range formed along the vertical plane V2 can be appropriately changed within the range from ½ of the length L3 between the side surface 111 of the tubular portion 110 and the wall surface portion 130 to a length equal to the length L3. For example, ⅔ of the range from the side surface 111 of the tubular portion 110 to the wall surface portion 130 may be formed along the vertical plane V2. When the range formed along the vertical plane V2 is set to ½ of the length L3, the along-end portion 123 should be shortened such that the length L4 of the along-end portion 123 is equal to ½ of the length L3. When the range formed along the vertical plane V2 is set to a length equal to the length L3, the along-end portion 123 should be extended to the position of the outer circumferential surface of the wall surface portion 130 by eliminating the inclined portion 124.

As illustrated in FIGS. 1 and 2, a partition wall 160 is integrated in the center of the lane rope float 100, and a water hole 161 that allows water to flow in from the front and back is formed in the partition wall 160. Since six blades 120 are arranged at equal intervals, that is, at 60-degree intervals, around the tubular portion 110 in the lane rope float 100, the blades 120 facing each other are aligned in a straight line. The number or arrangement of the blades 120 can be appropriately changed without being limited to the aspect illustrated in FIGS. 1 and 2.

The entire lane rope float 100 is integrally molded by injection molding a foamable synthetic resin in order to make it float on water, and as the synthetic resin, polypropylene, polyethylene, etc., can be adopted. In performing the injection molding, a melted synthetic resin is poured into a metal mold shaped like the lane rope float 100 from the side of the outer end 112 of the tubular portion 110.

Figure 3B:
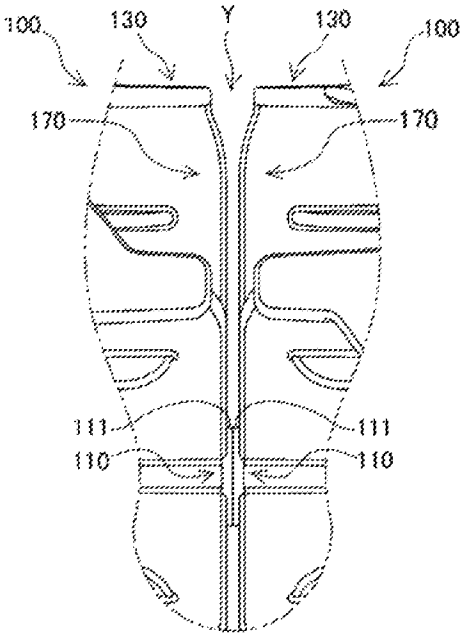
FIG. 3(*a*) is a side view in which a plurality of lane rope floats are attached to a rope, and FIG. 3(*b*) is a side view in which a portion near an outer end portion of the lane rope float of FIG. 3(*a*) is enlarged.
Figure 3A:
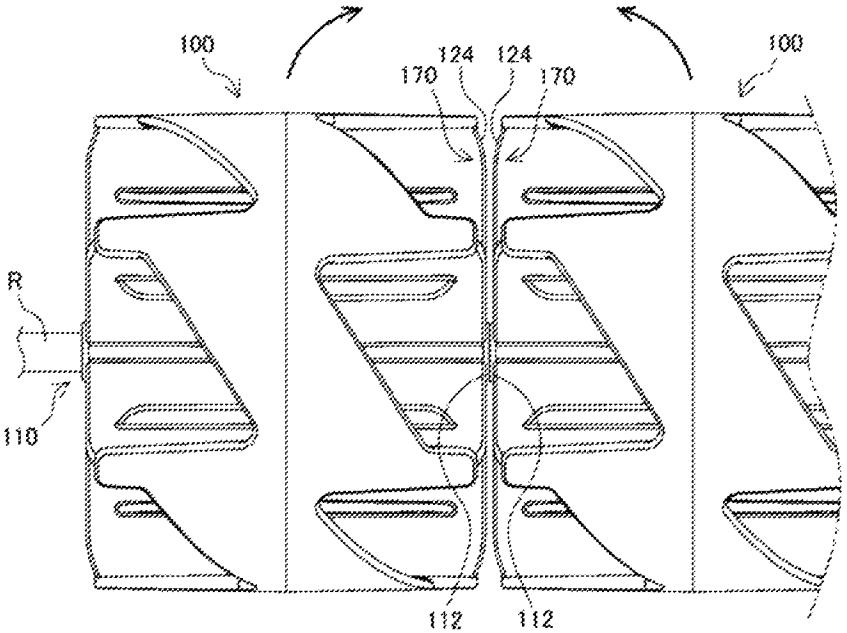

Next, a state in which a plurality of the lane rope floats 100 are attached to the rope R will be described with reference to FIG. 3. FIG. 3(*a*) is a side view of a state in which a plurality of the lane rope floats 100 are attached to the rope R, and FIG. 3(*b*) is a side view in which a portion near the outer end portion 170 of the lane rope float 100 in FIG. 3(*a*) is enlarged.

The rope R is first inserted through the tubular portion 110 of each lane rope float 100, as illustrated in FIG. 3(*a*), and the lane rope floats 100 are linearly aligned without gaps such that the outer ends 112 of the tubular portions 110 of the lane rope floats 100 come into contact with each other.

In each outer end portion 170, at least ½ of the range from the center of the tubular portion 110 to the wall surface portion 130 is formed along the vertical plane V2, or at least ½ of the range from the side surface 111 of the tubular portion 110 to the wall surface portion 130 is formed along the vertical plane V2, as illustrated in FIGS. 2, 3(*a*), and 3(*b*). Therefore, the outer end portions 170, facing each other, are extremely close to each other in a state of being parallel with each other within at least ½ of the range from the center of the tubular portion 110 to the wall surface portion 130, or within at least ½ of the range from the side surface 111 of the tubular portion 110 to the wall surface portion 130. As a result, a gap Y between the adjacent lane rope floats 100 becomes remarkably smaller as compared with a big gap X (see FIG. 8(*c*)) between lane rope floats of conventional technologies. According to the lane rope float 100 of the invention of the present application, the gap Y is remarkably small, and hence the waves created by a swimmer in each lane are hardly allowed to pass to the adjacent lane, whereby wave absorbing performance is more improved than before.

In the outer end portion 170 of the lane rope float 100 illustrated in FIGS. 1 and 2, at least ½ of the range from the center of the tubular portion 110 to the wall surface portion 130 is formed along the vertical plane V2 (hereinafter, referred to as a first characteristic), and further at least ½ of the range from the side surface 111 of the tubular portion 110 to the wall surface portion 130 is formed along the vertical surface V2 (hereinafter, referred to as a second characteristic); however, it is not necessary to satisfy the first characteristic and the second characteristic at the same time, and when having either the first characteristic or the second characteristic, the lane rope float 100 of the invention of the present application has the effect of improving wave absorbing performance to a higher level than before.

Since the lane rope float 100 is used by being floated on water surface, the adjacent lane rope floats 100 may move inward together by the waves created on water surface (see the arrows illustrated in FIG. 3(*a*)). Then, the outer end portions 170 of the adjacent lane rope floats 100 may collide or be caught with each other. However, the outer end 112 of the tubular portion 110 of the lane rope float 100 protrudes slightly, and hence the outer end portions 170 are slightly spaced apart from each other without being in close contact with each other. Therefore, the lane rope floats 100 can be prevented from colliding or being caught with each other. Also, the side end of the outer end portion 170 is the inclined portion 124 that is inclined toward the wall surface portion 130, and hence when the adjacent lane rope floats 100 move inward together (see the arrows illustrated in FIG. 3(*a*)), the wall surface portions 130 or the side ends of the outer end portions 170 can be effectively prevented from colliding or being caught with each other.

In the lane rope float 100 of the invention of the present application illustrated in FIGS. 1 to 3, the outer end 112 of the tubular portion 110 protrudes from the outer end 122 of the blade 120 by several sub-millimeters (e.g., from 0.1 mm or more to less than 1 mm), and the lane rope floats 100 are spaced apart from each other by the gap Y. The actual gap Y is small and hard to see, but for convenience of explanation, the gap Y is illustrated, in the drawings, to be a little more conspicuous than actual one.

In the lane rope float 100 of the invention of the present application illustrated in FIGS. 1 and 2, the height of the outer end 112 of the tubular portion 110 is set to several sub-mm (millimeters), but without being limited to this, the height may be removed such that the outer end 112 of the tubular portion 110 and the outer end 122 of the blade 120 are located on the same plane.

Figure 4A:
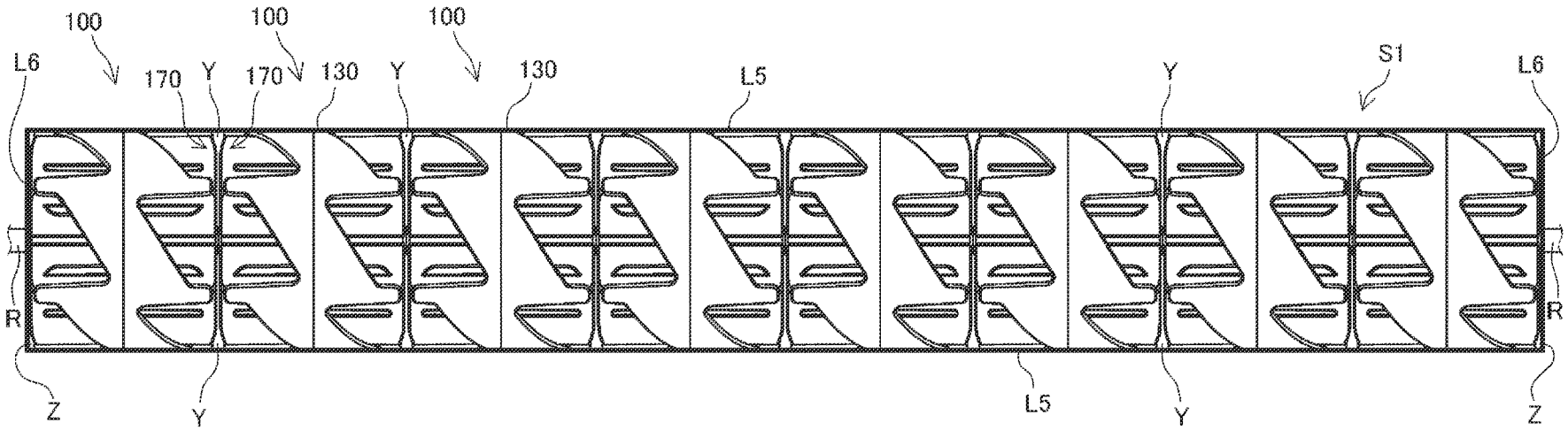
FIG. 4(*a*) is a side view in which a total of 8 lane rope floats are attached to a rope, and FIG. 4(*b*) is a side view in which the lane rope float at an end is enlarged.
Figure 4B:
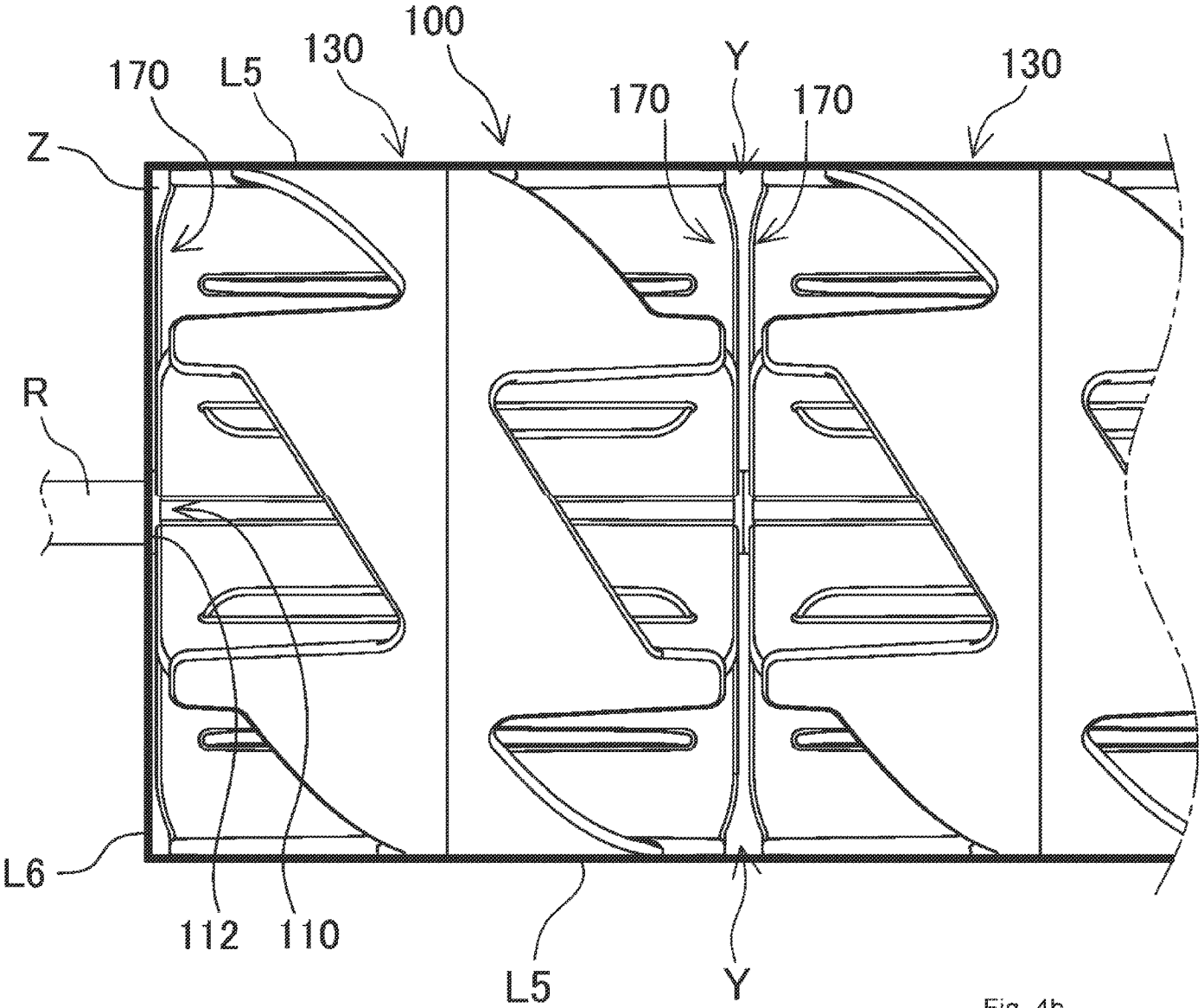

Next, the wave absorbing performance of the lane rope float 100 of the invention of the present application will be described by showing numerical values, with reference to FIG. 4. FIG. 4(*a*) is a side view of a state in which a total of 8 lane rope floats 100 are attached to the rope R, and FIG. 4(*b*) is a side view in which the lane rope float 100 located at an extreme end is enlarged. When a plurality of the lane rope floats are attached continuously, the wave absorbing performance should be expressed by a void ratio among the lane rope floats within the range of 1 m (meter) inside view.

Herein, the range within 1 m (meter) in side view means an area S1 of the quadrangle that is, in the side view illustrated in FIG. 4(*a*), surrounded by straight lines L5 each connecting the respective wall surface portions 130 of the lane rope floats 100 and straight lines L6 each intersecting at right angles with the straight lines L5 and being into contact with the outer end portion 170 of the lane rope float 100 located at an extreme end. As illustrated in FIG. 4(*b*), the straight line L6 is into contact with the outer end 112 of the tubular portion 110, the outer end 112 constituting the outer end portion 170.

In the area S1 of the quadrangle, spaces not occupied by the lane rope floats 100, that is, gaps exist. Specifically, the gap Y exists between the adjacent lane rope floats 100, and in each of the lane rope floats 100 at both ends, a gap Z exists between the outer end portion 170 of the lane rope float 100 and the straight line L6.

Therefore, when it is assumed that an area obtained by totaling all the gaps Y and all the gaps Z is S2, the ratio of the area S2 to the area S1 of the quadrangle is the void ratio among the lane rope floats within the range of 1 m (meter) inside view. This void ratio (%) is derived by dividing the area S2 with the area S1 and then by multiplying with 100, that is, derived by the calculation formula of void ratio (%)=(S2/S1)×100.

In the lane rope float 100 of the invention of the present application, the outer end portions 170 of the lane rope floats 100, facing each other, are extremely close to each other in a state of being parallel with each other within at least ½ of the range from the center of the tubular portion 110 to the wall surface portion 130, or within at least ½ of the range from the side surface 111 of the tubular portion 110 to the wall surface portion 130. As a result, the gap Y between the adjacent lane rope floats 100 becomes remarkably smaller as compared with the big gap X (see FIG. 8(*c*)) between lane rope floats of conventional technologies.

Therefore, the void ratio among the lane rope floats within the range of 1 m (meter) inside view, as illustrated in FIG. 4, can be set to 5% or less. By making the void ratio 5% or less, as described above, the waves created by a swimmer in each lane are hardly allowed to pass to the adjacent lane, whereby wave absorbing performance is more improved than before. It is better to make the void ratio 3% or less, and further preferable to make it 2% or less.

However, when a configuration, in which the void ratio among the lane rope floats within the range of 1 m (meter) inside view can be set to 5% or less, is adopted, the height of the outer end 112 of the tubular portion 110, the length L4 of the along-end portion 123, and the length and inclination angle of the inclined portion 124 can be arbitrarily set. For example, when the height of the outer end 112 is made smaller, the gap Y becomes further smaller, and hence the void ratio becomes further smaller. Also, when the inclination angle of the inclined portion 124 to the along-end portion 123 is made smaller (i.e., when the inclined portion 124 is brought closer to the vertical plane V2), the gap Y becomes further smaller, and hence the void ratio becomes further smaller.

Figure 5:
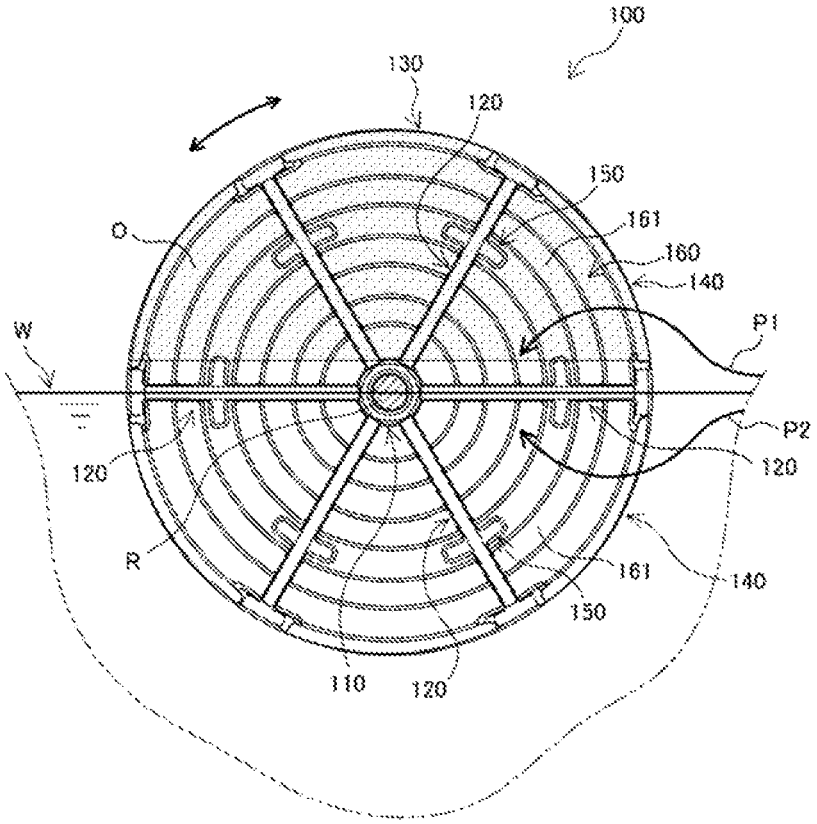
FIG. 5 is a front view of a lane rope float, in which a plurality of lane rope floats are attached to a rope and they are floated on the water surface of a pool.

Next, an action, in which the lane rope float 100 floating on a water surface W of a pool absorbs waves, will be described with reference to FIG. 5. FIG. 5 is a front view of the lane rope float 100 in a state in which a plurality of the lane rope floats 100 are attached to the rope R such that they are floated on the water surface W of a pool.

As illustrated in FIG. 5, the rope R is installed near the water surface W, and the lane rope float 100 attached to the rope R is floating on the water surface W. It is assumed that in this state, the waves created by a swimmer in the adjacent lane travel toward the lane rope float 100 from the side of the lane rope float 100. Then, part of the waves enter the inside of the lane rope float 100 from the opening 140 floating above the water surface W, as illustrated by an arrow P1, while shaking the water surface W up and down. Also, the other part of the waves enter the inside of the lane rope float 100 from the opening 140 sinking below the water surface W, as illustrated by an arrow P2. Then, the waves that have entered the inside of the lane rope float 100 collide with the blades 120 and the protruding plates 150, and with the force created at the time, the lane rope float 100 is shaken up and down, or the lane rope float 100 swings around the rope R. The kinetic energy of the waves is consumed by being converted into the rotational energy of the lane rope float 100, as described above, and as a result, the waves are absorbed.

When the lane rope float 100 is installed such that the two blades 120, lined up in a straight line around the tubular portion 110, are located at substantially the same height as the water surface W, as illustrated particularly in FIG. 5, wave absorbing performance is improved. Specifically, since the lower half of the lane rope float 100 sinks in water, water flows into the space separated by the blades 120 located in the lower half. Then, the lane rope float 100 has to rotate such that the water that has flowed into the lower half is drained off, and hence the rotational energy of the lane rope float 100 is consumed that much, and as a result, wave absorbing performance is improved. On the other hand, if more than the lower half of the lane rope float 100 sinks in water, the upper portion of the lane rope float 100, floating above the water surface W, becomes less. Then, the waves become easy to move over the lane rope float 100, and it becomes impossible to surely absorb the waves. Therefore, when the lane rope float 100 is installed such that the two blades 120, lined up in a straight line around the tubular portion 110, are located at a height substantially the same as the water surface W, the lower half of the lane rope float 100 just sinks in water, and hence wave absorbing performance is improved.

The fact that the two blades 120, lined up in a straight line around the tubular portion 110, are located at a height substantially the same as the water surface W includes not only the case where the blades 120 are located on the same plane as the water surface W, but also the case where the blades 120 are located slightly up and down from the water surface W.

Also, in order to install the lane rope float 100 such that the two blades 120, lined up in a straight line around the tubular portion 110, are located at a height substantially the same as the water surface W, as illustrated in FIG. 5, the specific gravity of the lane rope float 100 is set to be within the range of 0.4 to 0.6. In particular, when the specific gravity of the lane rope float 100 is set to be within the range of 0.5 to 0.6, the state illustrated in FIG. 5 can be achieved more surely. The specific gravity of the lane rope float 100 can be easily changed by, for example, appropriately changing the blending amount or type of a foaming agent that constitutes the lane rope float 100.

So far, the characteristic that in the lane rope float 100 of the invention of the present application, the two blades 120, lined up in a line around the tubular portion 110, are located at a height substantially the same as the water surface W has been described, but in addition to that, the lane rope float 100 of the invention of the present application has the characteristic that the portion above the tubular portion 110 is located above the water surface W, and hence the characteristic will be described below.

When a portion O (see the portion illustrated in gray in FIG. 5) of the lane rope float 100, above the tubular portion 110, is located above the water surface W, as illustrated in FIG. 5, the lane rope float 100 has to rotate such that the water that has flowed into the approximately lower half of the lane rope float 100 is drained off, because the approximately lower half sinks in water. Therefore, the rotational energy of the lane rope float 100 is consumed that much, and as a result, wave absorbing performance is improved. On the other hand, if more than the approximately lower half of the lane rope float 100 sinks in water, the upper portion of the lane rope float 100, floating above the water surface W, becomes less. Then, the waves become easy to move over the lane rope float 100, and it becomes impossible to surely absorb the waves. Therefore, when the portion O of the lane rope float 100, above the tubular portion 110, is located above the water surface W, the approximately lower half of the lane rope float 100 sinks in water, and hence wave absorbing performance is improved.

Also, in order to install the lane rope float 100 such that the portion O of the lane rope float 100, above the tubular portion 110, is located above the water surface W, as illustrated in FIG. 5, the specific gravity of the lane rope float 100 is set to be within the range of 0.4 to 0.6. In particular, when the specific gravity of the lane rope float 100 is set to be within the range of 0.5 to 0.6, the state illustrated in FIG. 5 can be achieved more surely.

In the lane rope float 100 illustrated in FIG. 5, the lane rope float 100 is installed such that the two blades 120, lined up in a straight line around the tubular portion 110, are located at a height substantially the same as the water surface W (hereinafter, referred to as a third characteristic), and further the lane rope float 100 is installed such that the portion O of the lane rope float 100, above the tubular portion 110, is located above the water surface W (hereinafter, referred to as a fourth characteristic); however, it is not necessary to satisfy the third characteristic and the fourth characteristic at the same time, and the lane rope float 100 may have either the third characteristic or the fourth characteristic.

Although various types of lane rope floats are known in the world, good wave absorbing performance is not generally obtained, when in the state of being attached to the rope installed in a pool, the lane rope floats sink too much in water or float too much above the water surface. So, a plurality of characteristics A to C for obtaining good wave absorbing performance have been found in the present application. The respective following characteristics come into effect individually, but may be adopted in combination. As long as any one of the characteristics A to C is included, the configuration of the lane rope float is not particularly limited, and the existing lane rope floats may be adopted in addition to the lane rope floats 100 of the present application.

Specifically, the characteristic A relates to an installation structure of a lane rope float including at its center a tubular portion, in which the lane rope float, including two blades lined up in a straight line around the tubular portion, is installed such that in a state in which the lane rope float is attached to a rope installed in a pool via the tubular portion, the blades can be located at a height substantially the same as the water surface of the pool.

Next, the characteristic B relates to an installation structure of a lane rope float including at its center a tubular portion, in which the lane rope float is installed such that in a state in which the lane rope float is attached to a rope installed in a pool via the tubular portion, a portion of the lane rope float, above the tubular portion, can be located above the water surface of the pool.

Next, the characteristic C relates to a lane rope float, in which the specific gravity of the lane rope float is set to the range of 0.4 to 0.6, and more preferably to the range of 0.5 to 0.6.

In the lane rope float including any one of the characteristics A to C or its installation structure, the upper half of the lane rope float floats above the water surface and the lower half sinks in water, and hence waves do not easily move over the lane rope float and further consumption of the rotational energy of the lane rope float becomes large, whereby high wave absorbing performance can be obtained.

Next, a lane rope float 100A of a first variation of the lane rope float 100 will be described with reference to FIG. 6(*a*). FIG. 6(*a*) is a side view of the lane rope float 100A, in which a portion near an outer end portion 170A is enlarged. The configuration of the lane rope float 100A is different from that of the lane rope float 100 in that a protrusion 180A is provided in part of the outer end portion 170A, but the others are the same as those of the lane rope float 100, and hence detailed description will be omitted.

First, the protrusion 180A is formed to protrude outward from the surface of an outer end 122A of a blade 120A, as illustrated in FIG. 6(*a*). Therefore, even if the adjacent lane rope floats 100A, of a plurality of the lane rope floats 100A attached to the rope R, collide with each other by being shaken with waves, as illustrated in FIG. 3(*a*), the protrusion 180A, protruding more than the outer end 122A, first comes into contact with the outer end portion 170A of the adjacent lane rope float 100A, and hence the adjacent outer end portions 170A can be prevented from being caught with each other.

The protrusion 180A is formed in the outer end 122A of the blade 120A, but it may be formed in an outer end 112A of a tubular portion 110A. The height of the protrusion 180A is set to be several mm (millimeters) or less.

Next, a lane rope float 100B of a second variation of the lane rope float 100 will be described with reference to FIG. 6(*b*). FIG. 6(*b*) is a front view of the lane rope float 100B, in which a portion near a blade 120B is enlarged. The configuration of the lane rope float 100B is different from that of the lane rope float 100 in that the shape of the blade 120B is different from that of the blade 120, but the others are the same as those of the lane rope float 100, and hence detailed description will be omitted.

As illustrated in FIG. 6(*b*), the blade 120B is formed to be gradually thicker from a tubular portion 110B toward a wall surface portion 130B. Therefore, the lane rope float 100B is accurately formed as designed. Specifically, in injection molding the lane rope float 100B, a melted synthetic resin is poured into a metal mold from the side of the outer end 112B of the tubular portion 110B. Then, the melted synthetic resin is poured in toward the wall surface portion 130B from the tubular portion 110B via the blade 120B within the metal mold. Therefore, by forming the blade 120B, a passage through which a synthetic resin flows, so as to be gradually thicker from the tubular portion 110B, an inflow side, toward the wall surface portion 130B, a terminal side, the synthetic resin can be easily poured in without stagnation to the terminal side. As a result, the synthetic resin is poured into the terminal side of the metal mold, whereby the lane rope float 100B is accurately molded as designed.

Since the blade 120B is formed to be gradually thicker from the tubular portion 110B toward the wall surface portion 130B, the moment of inertia of the outermost portion of the lane rope float 100B becomes large. Then, when the lane rope float 100B swings around the rope R by wave power, the lane rope float 100B should use a lot of wave energy, whereby wave absorbing performance is improved that much.

Next, a lane rope float 100C of a third variation of the lane rope float 100 will be described with reference to FIG. 6(*c*). FIG. 6 (*c*) is a front view of the lane rope float 100C, in which a portion near a blade 120C is enlarged. The configuration of the lane rope float 100C is different from that of the lane rope float 100 in that the shape of a wall surface portion 130C is different from that of the wall surface portion 130, but the others are the same as those of the lane rope float 100, and hence detailed description will be omitted.

As illustrated in FIG. 6(*c*), the wall surface portion 130C is formed such that the thickness is larger than that of the blade 120C. Therefore, the lane rope float 100C is accurately formed as designed. Specifically, in injection molding the lane rope float 100C, a melted synthetic resin is poured into a metal mold from the side of an outer end 112C of a tubular portion 110C. Then, the melted synthetic resin is poured in toward the wall surface portion 130C from the tubular portion 110C via the blade 120C within the metal mold. Therefore, by forming the wall surface portion 130C on the terminal side such that the thickness is larger than that of the blade 120C, a passage through which a synthetic resin flows, the synthetic resin can be easily poured in without stagnation to the terminal side. As a result, the synthetic resin is poured into the terminal side of the metal mold, whereby the lane rope float 100C is accurately molded as designed.

Since the wall surface portion 130C is formed such that the thickness is larger than that of the blade 120C, the moment of inertia of the outermost portion of the lane rope float 100C becomes large. Then, when the lane rope float 100C swings around the rope R by wave power, the lane rope float should use a lot of wave energy, whereby wave absorbing performance is improved that much.

Second Embodiment

Figure 7A:
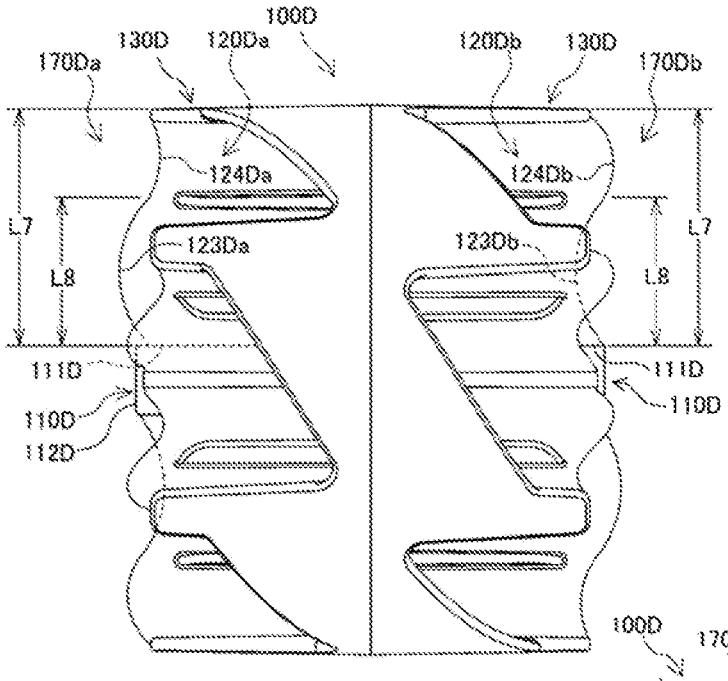
FIG. 7(*a*) is a side view of a lane rope float according to a second embodiment of the invention of the present application, FIG. 7(*b*) is a side view in which a plurality of lane rope floats are attached to a rope, and FIG. 7(*c*) is a side view in which portions near both one outer end portion and the other outer end portion of the lane rope float in FIG. 7(*b*) are enlarged.
Figure 7C:
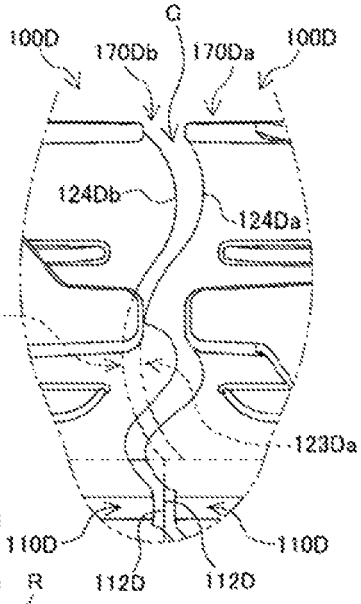
Figure 7B:
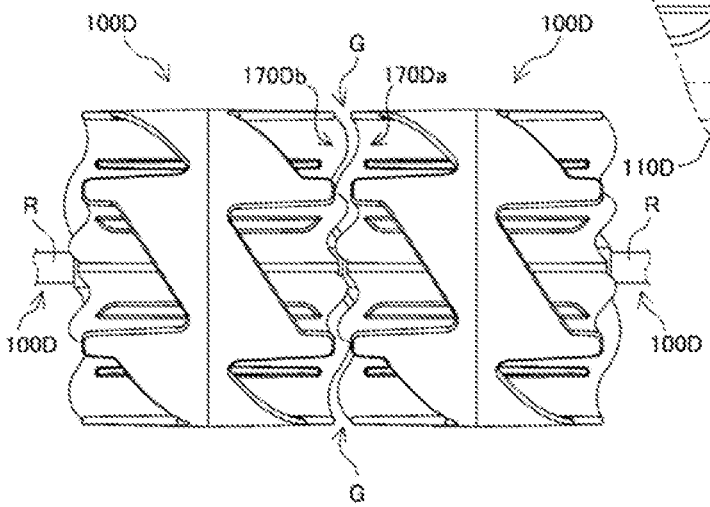

Next, a lane rope float 100D according to a second embodiment of the invention of the present application will be described with reference to FIG. 7. FIG. 7(*a*) is a side view of the lane rope float 100D, FIG. 7(*b*) is a side view of a state in which a plurality of the lane rope floats 100D are attached to the rope R, and FIG. 7(*c*) is a side view in which portions near both one outer end portion 170Da and the other outer end portion 170*db* of the lane rope float 100D in FIG. 7(*b*) are enlarged. The configuration of the lane rope float 100D is different from that of the lane rope float 100 in that the configurations of the one outer end portion 170Da and the other outer end portion 170*db* are different from that of the outer end portion 170, but the others are the same as those of the lane rope float 100, and hence detailed description will be omitted.

In the one outer end portion 170Da of the lane rope float 100D, part of a blade 120Da constitutes a convex-shaped portion 123Da having a convex shape, as illustrated in FIG. 7(*a*). When it is assumed that in the outer end portion 170Da, the length between a side surface 111D of a tubular portion 110D and a wall surface portion 130D is L7, a length L8 of the convex-shaped portion 123Da is at least ½ of the length L7 or more. That is, in the outer end portion 170Da of the lane rope float 100D, at least ½ of the range from the side surface 111D of the tubular portion 110D to the wall surface portion 130D is convex-shaped.

On the other hand, in the other outer end portion 170*db* of the lane rope float 100D, part of a blade 120*db* constitutes a concave-shaped portion 123*db* having a concave shape. The concave-shaped portion 123*db* has a corresponding shape to match the convex-shaped portion 123Da. When it is assumed that in the outer end portion 170*db*, the length between the side surface 111D of the tubular portion 110D and the wall surface portion 130D is L7, a length L8 of the concave-shaped portion 123*db* is at least ½ of the length L7 or more. That is, in the outer end portion 170*db* of the lane rope float 100D, at least ½ of the range from the side surface 111D of the tubular portion 110D to the wall surface portion 130D is concave-shaped.

Therefore, when a plurality of the lane rope floats 100D are attached to the rope R, the convex-shaped portion 123Da of the outer end portion 170Da of one of the adjacent lane rope floats 100D and the concave-shaped portion 123*db* of the outer end portion 170*db* of the other lane rope float 100D are lined up to face each other while keeping a predetermined distance, as illustrated in FIGS. 7(*b*) and 7(*c*). That is, between the one outer end portion 170Da and the other outer end portion 170*db*, both of the ranges, each being at least ½ of the range from the side surface 111D of the tubular portion 110D to the wall surface portion 130D, are extremely close to each other in a state of being parallel with each other while keeping a predetermined distance between them. As a result, a gap G between the adjacent lane rope floats 100D becomes remarkably smaller as compared with the big gap X (see FIG. 8(*c*)) between the lane rope floats of conventional technologies. According to the lane rope float 100D of the invention of the present application, the gap G is remarkably small, and hence the waves created by a swimmer in each lane are hardly allowed to pass to the adjacent lane, whereby wave absorbing performance is more improved than before. Since the outer ends 112D of both the tubular portions 110D come into contact with each other, the convex-shaped portion 123Da and the concave-shaped portion 123*db* are spaced apart from each other by the height of the outer end 112D, as illustrated in FIG. 7(*c*). That is, the predetermined distance becomes equal to the height of the outer ends 112D facing each other.

In the one outer end portion 170Da and the other outer end portion 170*db* of the lane rope float 100D, the range formed into a convex shape or a concave shape can be appropriately changed within the range from ½ of the length L7 between the side surface 111D of the tubular portion 110D and the wall surface portion 130D to a length equal to the length L7. In the one outer end portion 170Da and the other outer end portion 170*db*, for example, ⅔ of the range from the side surface 111D of the tubular portion 110D to the wall surface portion 130D may be formed into a convex shape or a concave shape (as described later, ⅔ of the range may be formed into a concave-convex shape including a plurality of concavities and convexities). When the range formed into a convex shape or a concave shape is set to ½ of the length L7, the convex-shaped portion 123Da and the concave-shaped portion 123*db* should be shortened such that the length L8 of the convex-shaped portion 123Da and the concave-shaped portion 123*db* is equal to ½ of the length L7. When the range formed into a convex shape or a concave shape is set to a length equal to the length L7, the convex-shaped portion 123Da and the concave-shaped portion 123*db* should be extended to the wall surface portion 130D by eliminating an end portion 124Da and an end portion 124*db*. In the lane rope float 100D illustrated in FIG. 7, at least ½ of the range from the side surface 111D of the tubular portion 110D to the wall surface portion 130D is formed into a convex shape in the one outer end portion 170Da, but without being limited to this, it may be formed into, for example, a concave-convex shape including a plurality of concavities and convexities. In that case, the shape of the other outer end portion 170*db* is also changed to correspond to the concave-convex shape. The end portion 124Da and the end portion 124*db* may be formed into any shape, but in FIG. 7, they have shapes in which they are spaced apart from each other such that the adjacent wall surface portions 130D are not caught with each other.

The lane rope float of the invention of the present application is not limited to the above embodiments, and various modifications and combinations are possible within the scope of the claims and the scope of the embodiments, and these modifications and combinations are also included within the scope of the right.

The invention claimed is:

1. A lane rope float that is attached to a rope via a tubular portion and divides lanes of a pool, the lane rope float comprising:

a plurality of blades that protrude from a side surface of the tubular portion in parallel with the rope; and a wall surface portion that is coupled to side end portions of the blades to cover the blades, wherein protruding plates are formed on the blades in parallel with the rope so as to protrude from the inner surface of the blades, the protruding plates are coupled to a partition wall formed at the center of the lane rope float and are coupled to only one of the blades facing each other.

2. A lane rope float that is attached to a rope via a tubular portion and divides lanes of a pool, the lane rope float comprising:

outer end portions on both outer sides;

a plurality of blades that protrude from a side surface of the tubular portion in parallel with the rope; and a wall surface portion that is coupled to side end portions of the blades to cover the blades, wherein the blades and the wall surface portion are integrally formed, an opening obliquely formed is formed on the wall surface portion, the blades, the wall surface portion and the opening are formed on the outer end portions on the both outer sides of the lane rope float, respectively.

* * * * *